US009301562B1

(12) United States Patent
Chen

(10) Patent No.: US 9,301,562 B1
(45) Date of Patent: Apr. 5, 2016

(54) GLOVE GUN

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 14/517,146

(22) Filed: Oct. 17, 2014

(51) Int. Cl.
*A41D 19/00* (2006.01)
*A63B 71/14* (2006.01)

(52) U.S. Cl.
CPC ..... *A41D 19/0027* (2013.01); *A63B 71/141* (2013.01); *A63B 2220/17* (2013.01)

(58) Field of Classification Search
CPC ..... F11A 33/00; G06F 3/014; G06K 7/10; G06K 7/10009; G06K 5/00; A63H 33/22; A63H 33/30; A41D 25/00; A41D 19/00
USPC ..... 358/473, 475, 509, 510, 51, 513, 480, 358/482, 313, 321; 2/158, 159, 161.1, 2/161.5; 446/219, 473; 235/462.01, 235/462.14, 462.24, 462.25, 462.38, 235/462.39, 462.32, 462.33, 472.01, 472.02
See application file for complete search history.

(56) References Cited

U.S. PATENT DOCUMENTS

| | | | | |
|---|---|---|---|---|
| 4,370,696 | A * | 1/1983 | Darrell | F41B 15/04 231/7 |
| 5,744,788 | A * | 4/1998 | Metlitsky | G06K 7/10564 235/454 |
| 6,257,893 | B1 * | 7/2001 | Trabut | F41A 33/00 434/11 |
| 7,405,726 | B2 * | 7/2008 | Pelosi | G01S 3/784 345/158 |
| 7,612,923 | B2 * | 11/2009 | Rusman | G06F 3/014 235/462.01 |
| 2011/0225698 | A1 * | 9/2011 | Haga | A41D 13/00 2/69 |

* cited by examiner

*Primary Examiner* — Gloria Hale
(74) *Attorney, Agent, or Firm* — Clement Cheng

(57) ABSTRACT

A glove gun comprising a glove having a hand opening for receiving a hand of the user, a thumb opening, a little finger opening, a ring finger opening, a middle finger opening, and an index finger opening. The glove has a glove top section opposing a palm section. A beam emitter is mounted to the glove on the glove top section. The beam emitter is a game weapon that shoots a beam from the beam emitter. The switch body has a switch. The switch body is attached to the palm section. A target has one or more beam receivers capable of receiving a signal from the beam emitter of the gun.

11 Claims, 4 Drawing Sheets

GLOVE GUN

FIELD OF THE INVENTION

The present invention is in the field of games.

DISCUSSION OF RELATED ART

A variety of trampoline games have been played on trampolines, such as basketball. Publicover describes a trampoline game accessory in United States publication 20050043122 published Feb. 24, 2005, the disclosure of which is incorporated herein by reference. The trampoline game includes a variety of electronic buttons located above a trampoline bed. Publicover in United States publication 20100190608 of Jul. 29 2000, describes a trampoline game system with additional optional accessories including variations of tag, hopscotch, volleyball, basketball and other modifications of traditional games which may include scoring a goal with a ball. Coiling in U.S. Pat. No. 7,481,740 issued Jan. 27, 2009 includes a soccer goal fitted on a portion of a trampoline enclosure net. Other inventors have created other designs, such as Chen in U.S. Pat. No. 6,918,846 provides for an inflatable basketball structure which can also be used for enclosing a trampoline structure.

The game of laser tag has been played in a variety of different locations, but has not yet been adapted to trampoline usage with a glove gun. In U.S. Pat. No. 8,764,611 entitled trampoline game, the trampoline game was played with a laser tag gun.

SUMMARY OF THE INVENTION

A glove gun comprising a glove having a hand opening for receiving a hand of the user, a thumb opening, a little finger opening, a ring finger opening, a middle finger opening, and an index finger opening. The glove has a glove top section opposing a palm section. A beam emitter is mounted to the glove on the glove top section. The beam emitter is a game weapon that shoots a beam from the beam emitter. A switch body has a switch. The switch body is attached to the palm section. A target has one or more beam receivers capable of receiving a signal from the beam emitter of the gun.

Optionally, the glove gun is a game that has at least one target attached to a trampoline for a user to shoot with the glove gun. Preferably there are more than two targets. Player attribute game parameters can be defined including a gun cooldown time defined as a set delay time that the glove gun requires before a successive shot is initiated. A bounce sensor senses user bounces. The bounce sensor outputs data wirelessly to the glove. A circuit or microprocessor on the glove can retain data. Game parameters can be programmed into a microprocessor that receives data. The bounce sensor outputs data to the microprocessor.

A wireless communication can be established between the bounce sensor and the glove. The ammunition count can be electronically maintained on the glove gun so that a user needs to activate the bounce sensor to obtain a certain number of shots per bounce. Optionally, a user is allotted a single shot which is depleted after one shot and requires that the user take another jump to activate the bounce sensor again for a second shot. Alternatively, the user can be given a goal of shooting more than one target on a single bounce. The user can be given more than one shot per bounce. A user jump activates the bounce sensor.

Figure 1:
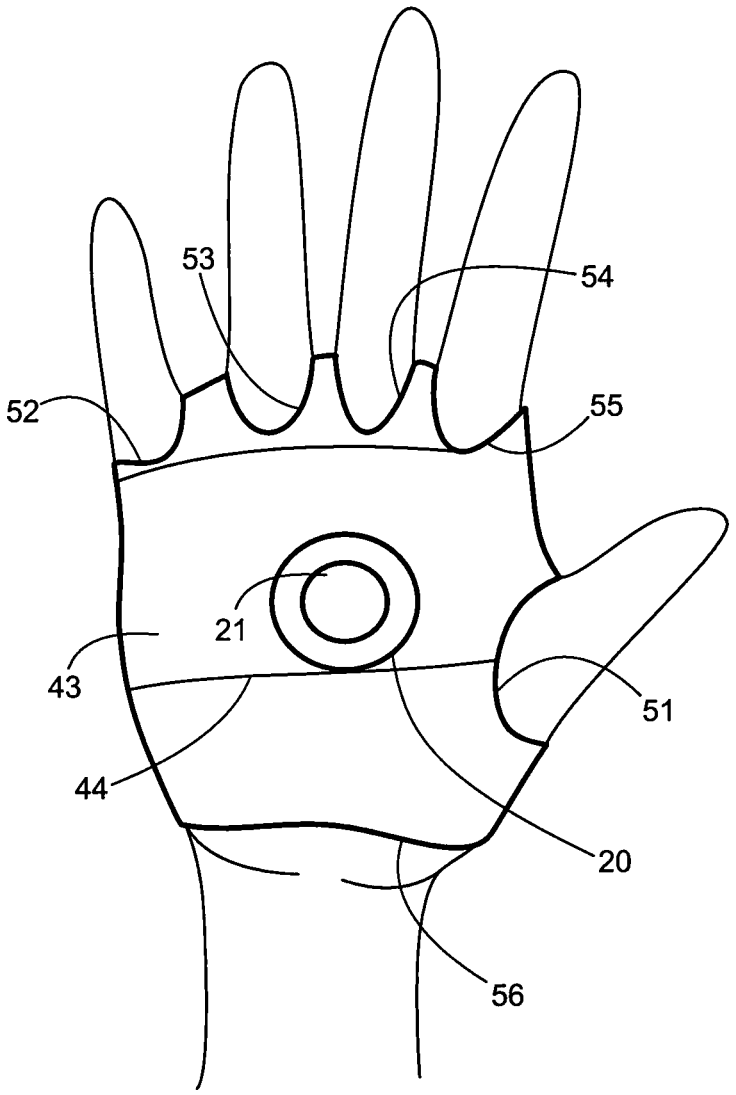
FIG. 1 is a diagram of a user wearing a glove gun.
Figure 2:
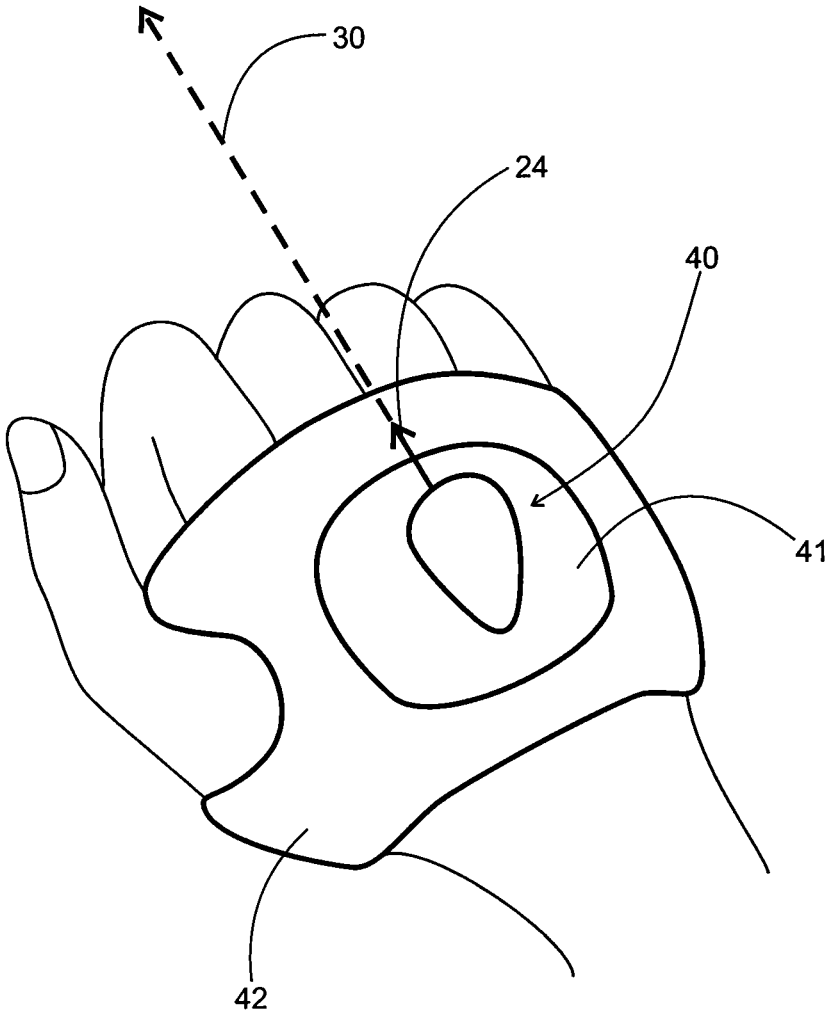
FIG. 2 is a diagram of a glove gun palm side.
Figure 3:
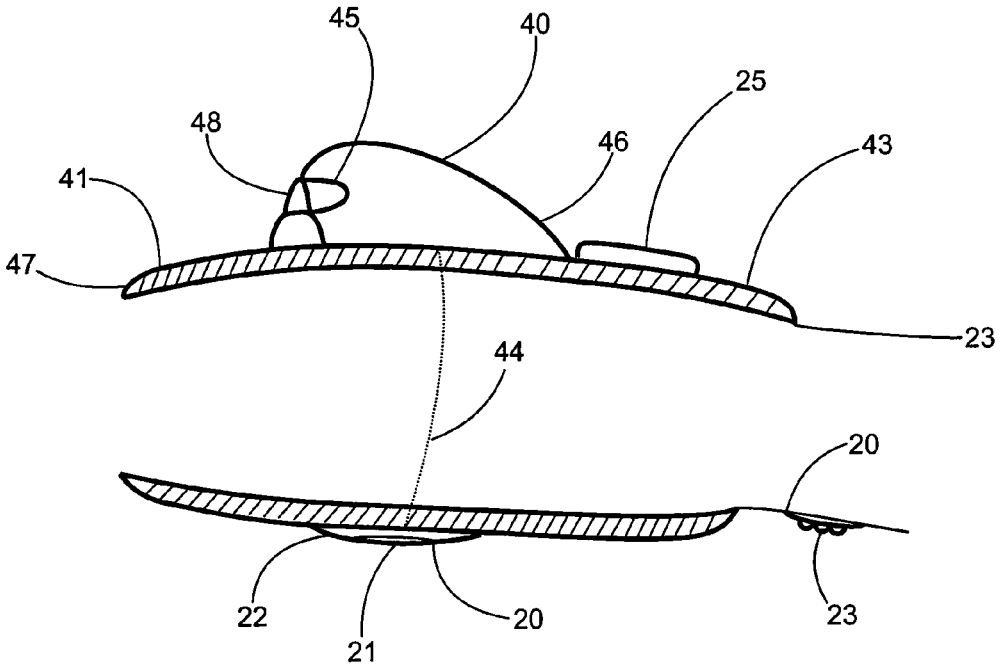
FIG. 3 is a cross section diagram of the first gun used for shooting the target.
Figure 4:
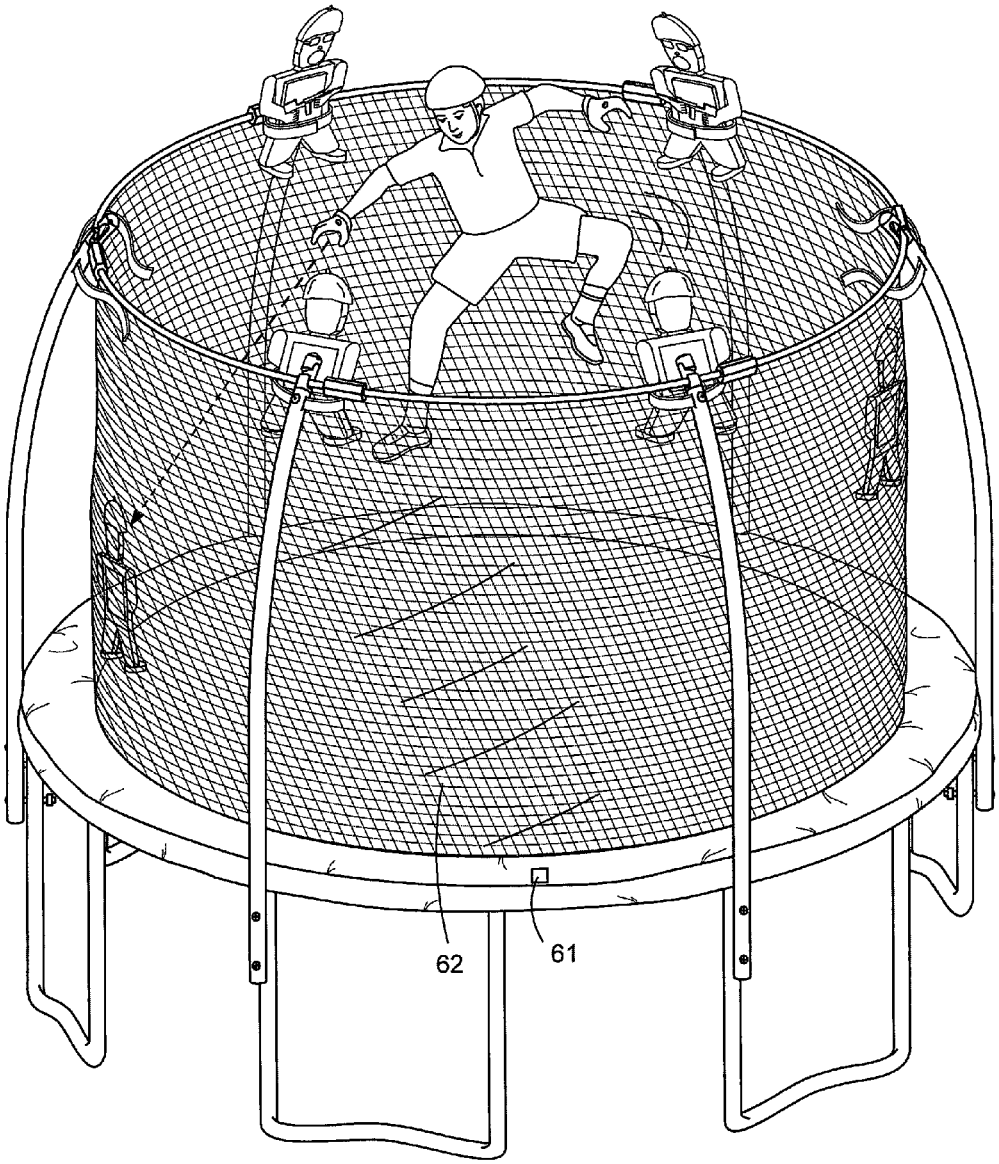
FIG. 4 is a diagram of a user on a trampoline shooting targets attached to the trampoline.

The following callout list of elements can be a useful guide in referencing the elements of the drawings.

20 Palm Switch
21 Switch Element
22 Switch Body
23 Grip
24 Beam Path Indicator
30 Beam
40 Beam Emitter
41 Shield Adapter
42 Glove Top Section
43 Palm Section
44 Electrical Connection
45 Emitter Lamp
46 Beam Emitter Housing
47 Shield Plate Adapter Profile
48 Beam Emitter Housing Opening
50 Glove Body
51 Thumb Opening
52 Little Finger Opening
53 Ring Finger Opening
54 Middle Finger Opening
55 Index Finger Opening
56 Hand Opening
61 Bounce Sensor
62 Wireless Connection

DETAILED DESCRIPTION OF THE PREFERRED EMBODIMENT

A glove has a glove body 50 that fits on a hand of the user provides an alternative gun in a laser tag support where typically infrared beams or other beams are used to tag upon players or stationary targets. Preferably, the glove emits a beam of infrared light, but ultraviolet or visible light is also usable though at the present time infrared is the best mode. The glove body is shaped like as a fingerless glove.

The glove may have a beam path indicator 24 drawn as a line on the glove that indicates a direction of the beam. The beam path indicator 24 can be mounted to the shield adapter 41. The shield adapter 41 is a flat plastic member that is preferably elastomeric to connect the glove top section 42 to the beam emitter housing 46. The glove top section 42 is preferably made of an elastic sheet such as a foam neoprene or polychloroprene synthetic rubber.

The glove top section 42 is fitted and configured for fitting a hand. The glove top section is connected to the glove's palm section 43. The palm section 43 has a palm switch 20 mounted to a palm side of the palm section 43. The palm switch 20 is mounted between a hand opening 56 and finger openings. The finger openings include a thumb opening 51, a little finger opening 52, a ring finger opening 53, a middle finger opening 54, and an index finger opening 55. The hand opening 56 can be a straight opening that does not conform to the shape of a wrist. An electrical connection 44 can be a copper wire that passes from the palm switch 20 around to the back of the hand at the glove top section 42. The electrical connection 44 optionally runs around a fringe of the hand opening 56 to the glove top section 42 and then through the shield adapter 41 to the beam emitter housing 46.

The beam 30 comes from the LED or emitter lamp 45. The beam emitter housing 46 secures the emitter lamp 45. The emitter lamp 45 forms an electrical circuit with the electrical connection 44 and the palm switch 20. The emitter lamp 45 can be made as an infrared, visible or ultraviolet LED, but is preferably an infrared element that can have a pulsing or encoded modulation. The beam emitter housing 46 also has a beam emitter housing opening 48 which exposes at least a portion of the emitter lamp 45. The beam emitter housing 46 is preferably made as a plastic injection molded unit that can be integrally formed with the shield adapter. The shield adapter preferably includes a shield adapter profile 47 which can be a beveled edge as seen in a cross-section. The shield adapter can be stitched to the glove top section 42 at a periphery of the shield adapter. Preferably, the shield adapter is relatively soft and flexible. The shield adapter stabilizes and maintains a safe barrier between the protruding beam emitter housing 46 and the users hand.

The shield adapter optionally includes a status indicator 25 such as a second LED or an LCD display that provides a score, or other secondary information such as a remaining battery charge, or secondary game information such as in game ammunition count. The glove may also have a grip 23 which can be disposed around a periphery of the palm switch 20. The palm switch 20 preferably has a switch element 21 which is either capacitive or contact in nature. The switch body 22 is flat and planar and preferably flexible. The switch element 21 can be bonded to the glove body 50 at the palm section 43.

Usage of the glove gun includes regular laser tag games which incidentally can be played on trampolines. The glove gun game can include a trampoline with targets attached to the trampoline. The glove gun can have a cooldown time which is a set time that the gun requires before a successive shot is initiated.

The bounce sensor 61 can be configured so that it can wirelessly communicate with the glove gun using a wireless connection 62 which can be a wireless protocol using radio waves. A bounce sensor 61 activation can be a prerequisite for loading the glove gun with ammunition so that a user needs to activate the bounce sensor 61 to obtain a certain number of shots per bounce. For example, a user can obtain a single shot which then depletes the shot count and requires that the user take another jump to reactivate the bounce sensor. In certain games, such as higher levels of a jump game, the user may have to shoot more than one target on a single bounce. In this case, the user may be given two or three shots per bounce.

Other technical details may include that the microprocessor is stored in the glove gun. For example, the microprocessor may be mounted in the gun and receive wireless signals from the bounce sensor, and receive and send wireless signals to and from the targets. Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A glove gun and target comprising:

a. a glove having a hand opening for receiving a hand of the user, a thumb opening, a little finger opening, a ring finger opening, a middle finger opening, and an index finger opening, wherein the glove has a glove top section opposing a palm section;

b. a beam emitter mounted to the glove on the glove top section, wherein the beam emitter shoots a beam from the beam emitter;

c. a switch body having a switch, wherein the switch body is attached to the palm section; and d. a target having one or more beam receivers capable of receiving a signal from the beam emitter of the gun.

2. The glove gun of claim 1, further including a trampoline, wherein the target is attached to the trampoline for a user to shoot with the glove gun.

3. The glove gun of claim 1, further comprising: player attribute game parameters with a gun cooldown time defined as a set delay time that the glove gun requires before a successive shot is initiated.

4. The glove gun of claim 1, further comprising: a bounce sensor for sensing user bounces; wherein the bounce sensor outputs data; and further comprising: defined game parameters programmed into a microprocessor that receives data; wherein the bounce sensor outputs data to the microprocessor.

5. The glove gun of claim 1, wherein the bounce sensor and the glove are configured to communicate with each other wirelessly.

6. The glove gun of claim 5, further comprising: an ammunition count, wherein the ammunition count is a number electronically maintained on the glove gun so that a user needs to activate the bounce sensor to obtain a certain number of shots per bounce.

7. The glove gun of claim 6, wherein the glove gun is configured to track user data where a user is allotted a single shot which is depleted after one shot and requires that the user take another jump to activate the bounce sensor again for a second shot.

8. The glove gun of claim 6, wherein the glove gun is configured to track user data where a user has a goal of shooting more than one target on a single bounce, wherein the user is given more than one shot per bounce, wherein a user jump activates the bounce sensor.

9. The glove gun of claim 6, further including a trampoline, wherein the target is attached to the trampoline for a user to shoot with the glove gun.

10. The glove gun of claim 6, further comprising: player attribute game parameters configured on the glove gun wherein the player attribute game parameters include a gun cooldown time defined as a set delay time that the glove gun requires before a successive shot is initiated.

11. The glove gun of claim 6, further comprising: a bounce sensor attached to the trampoline for sensing user bounces; wherein the bounce sensor outputs data; and further comprising: defined game parameters programmed into a microprocessor that receives data; wherein the bounce sensor outputs data to the microprocessor.

* * * * *